United States Patent [19]

Hooker

[11] 4,106,141

[45] Aug. 15, 1978

[54] BED FRAME

[75] Inventor: Joe Bryan Hooker, Lexington, N.C.

[73] Assignee: Leggett & Platt, Incorporated, Carthage, Mo.

[21] Appl. No.: 780,720

[22] Filed: Mar. 24, 1977

[51] Int. Cl.[2] ..... A47C 19/00

[52] U.S. Cl. ..... 5/201; 5/176 R; 5/181

[58] Field of Search ..... 5/176 R, 181, 200 R, 5/201, 202, 310

[56] References Cited

U.S. PATENT DOCUMENTS

| | | | |
|---|---|---|---|
| 2,019,203 | 10/1935 | Thompson | 5/310 |
| 2,911,656 | 11/1959 | Roche et al. | 5/310 |
| 3,100,304 | 8/1963 | Brandlin et al. | 5/310 |
| 3,736,602 | 6/1973 | Mitley | 5/176 R |

*Primary Examiner*—Casmir A. Nunberg
*Attorney, Agent, or Firm*—Wood, Herron & Evans

[57] ABSTRACT

A bed frame having a novel leg structure. The bed frame includes a right angle side rail, and a cross rail pivotally connected to that side rail for swinging movement between a storage position in which the cross rail is oriented parallel to the side rail, and a bed support or use position in which the cross rail is oriented normal to the side rail. The novel leg structure includes, in preferred form, a leg member having a U-shaped cross section at the top end thereof, the leg member being fixed to the cross rail adjacent the cross rail's pivotal connection with the side rail. A latch tab is connected with the leg member's center web by a neck having a width less than the width of the latch tab, the latch tab being spaced above the leg member's top edge. The latch tab, neck and leg member's top edge cooperate to define two slots which open away from one another in generally mirror relation. The use, and as the cross rail is swung from the storage attitude to the use attitude, the side rail's horizontal web is received in one of the slots, i.e., the side rail's web is located between the latch tab and the leg's top edge. This supports the cross rail relative to the side rail when the bed frame is erected. The same leg member may be mounted to a cross rail on either end of that cross rail, i.e., the same leg member structure may be used at either of the bed frame's two corners defined by that cross rail without regard to left hand side or right hand side of the bed frame, because of the two slot structure.

13 Claims, 12 Drawing Figures

BED FRAME

This invention relates to bed frames. More particularly, this invention relates to a novel leg structure for use with a bed frame of the right angle rail type.

Spring unit support frames are well known to the prior art. One type of spring unit support frame well known to the prior art is a bed frame. The bed frame is, of course, employed for the purpose of supporting mattress springs and mattress above floor level, thereby providing a bed for the user. Further, a right angle rail type of bed frame is also well known to the prior art. This latter type bed frame may be comprised of opposed right angle side rails disposed parallel one to the other, and opposed right angle head and foot rails also disposed parallel one to the other, the side rails and head and foot rails being connected together into a rectangular or bed frame configuration. Suitable mounting plates may be provided at the head end of the bed frame to permit interconnection with a headboard if desired.

When a right angle rail type bed frame is erected in rectangular configuration, as described, the bed frame is not easily transportable from manufacturer to retailer, nor from retailer to consumer. Hence, right angle rail type bed frame structures of the knock-down type are known. In this type bed frame, the head and foot cross rails are each comprised of connectable half section pairs, one of each half section pair being pivotally mounted to one side rail and the other of each half section pair being pivotally mounted to the other side rail. This knock-down bed frame includes connectors that permit the respective head and foot rail half sections to be connected together into a linear cross rail attitude when the bed frme is erected for use. During storage or transport, however, the head rail and foot rail half sections, after being disconnected, are swung or pivoted parallel to the side rails, and all the rails juxtaposed one to the other, so as to permit storing, or packaging and shipping, in a carton of relatively small cross section. Also known to the prior art are leg structures especially adapted for use with such bed frames. Typical knock-down right angle rail type bed frames, each with a different leg structure, are shown in U.S. Pat. Nos. 2,772,424, 2,857,602 and 2,911,656.

It has been one objective of this invention to provide a bed frame in which a novel leg structure on a cross rail cooperates with a right angle side rail to permit knocking down the bed frame for shipment or storage purposes, and to permit easy and simple erection of the bed frame by a user from the knocked down attitude, simply by swinging the cross rail between parallel and perpendicular alignment with the side rail to which that cross rail is pivotally connected.

It has been another objective of this invention to provide a bed frame in which a novel leg structure is connected to one of the frame's cross rails, that novel leg structure defining two slots that permit the same leg structure to be mounted at either of the frame's two corners as defined by that cross rail, one of the frame's side rails cooperating with one slot if the leg structure is mounted on one side of the bed frame and the other of the frame's side rails cooperating with the other slot if the leg structure is mounted on the other side of the bed frme, as the cross rail is swung into and out of parallel alignment with the side rail.

These objectives have been achieved in the bed frame with novel leg structure of this invention. The bed frame includes a right angle side rail, and a cross rail pivotally connected to that side rail for swinging movement between a storage position in which the cross rail is oriented parallel to the side rail, and a bed support or use position in which the cross rail is oriented normal to the side rail. The novel leg structure includes, in preferred form, a leg member having a U-shaped cross section at the top end thereof, the leg member being fixed to the cross rail adjacent the cross rail's pivotal connection with the side rail. A latch tab is connected with the leg member's center web by a neck having a width less than the width of the latch tab, the latch tab being spaced above the leg member's top edge. The latch tab, neck and leg member's top edge cooperate to define two slots which open away from one another is generally mirror relation. In use, and as the cross rail is swung from the storage attitude to the use attitude, the side rail's horizontal web is received in one of the slots, i.e., the side rail's web is located between the latch tab and the leg's top edge. This supports the cross rail relative to the side rail when the bed frame is erected. The same leg member may be mounted to a cross rail on either end of that cross rail, i.e., the same leg member structure may be used at either of the bed frame's two corners defined by that cross rail without regard to left hand side or right hand side of the bed frame.

Other objectives and advantages of this invention will be more apparent from the following detailed description taken in conjunction with the drawings in which.

Figure 1:
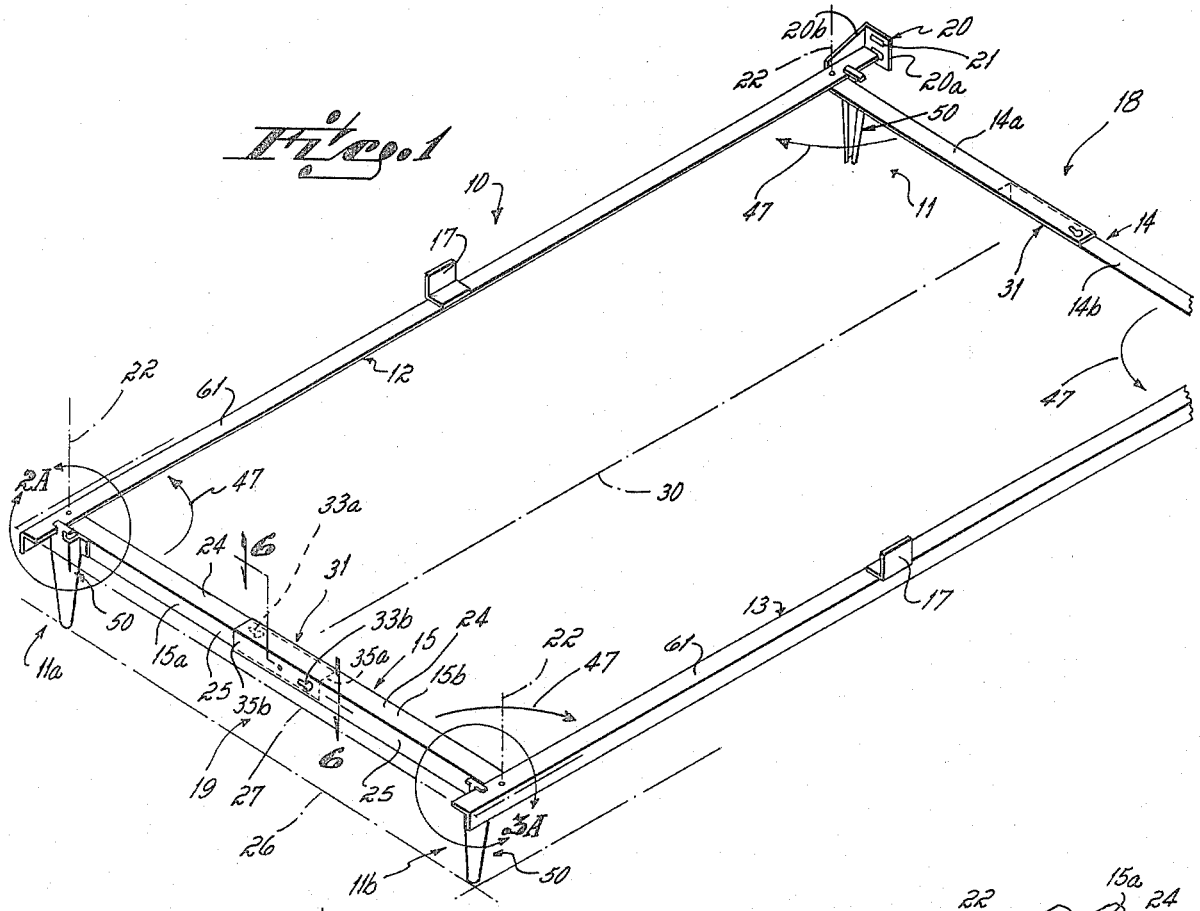
FIG. 1 is a perspective view of a first bed frame embodiment incorporating a novel leg structure, all in accord with the principles of this invention.

The first bed frame 10 embodiment and leg structure 11 of this invention is illustrated in FIGS. 1–6. The first bed frame 10 embodiment is of a twin bed size. The bed frame 10 includes opposed side rails 12, 13, i.e., left hand 12 and right hand 13 side rails, which are disposed in parallel relation one to the other when the bed frame is erected in the use position as shown in FIG. 1. The bed frame 10 also includes a head rail 14 and a foot rail 15, i.e., cross rails, which are also disposed parallel one to the other, and which are disposed normal to the side rails 12, 13, when the bed frame is erected in the use position illustrated in FIG. 1. A novel leg structure 11 is provided at each corner of the bed frame 10, each leg carrying a caster 16 or a roller or the like, as well known in the art, to provide mobility for the bed frame when it is erected. Note that the cross rails 14, 15 are the leg rails of the bed frame 10, i.e., the rails of the bed frame 10 to which the leg structures 10 are mounted. Note further that the side rails 12, 13 and cross rails 14, 15 (i.e., all cross rail sections 14*a*, 14*b* and 15*a*, 15*b*) are comprised of angle pieces which are right angular in configuration. Each angle piece includes a horizontal web or wall 24 and a vertical web or wall 25 as those rails 12–15 are oriented relative to floor 26. Note also that the side rail 12, 13 and cross rail 14, 15 angles are all oriented so that the horizontal webs 24 thereof are disposed in generally the same horizontal plane, which horizontal plane defines the support plane 27 for bed springs (not shown) of the bed frame 10. In other words, the vertical faces or side walls 25 of each right angle piece 12–15 (and, particularly, of each cross rail 14, 15) depends downwardly from the horizontal walls or webs 24 which define support plane 27, i.e., extend below and not above that support plane.

An upwardly extending restraining tab 17 is also fixed to each side rail 12, 13, those restraining tabs being disposed generally midway between the head 18 and foot 19 ends of the side rails. The restaining tabs 17 serve to aid in maintaining the bed springs (not shown) on the bed frame 10 when it is made up so a bed. A headboard mounting plate 20 (only one of which is shown in FIG. 1) is connected to each side rail 12, 13 at the head end 18 thereof, as is well known to the prior art. Each headboard mounting plate 20 provides a slot 21 adapted to receive a connecting bolt (not shown) so as to connect a headboard (not shown) to the bed frame 10 if desired. Each headboard mounting plate 20 includes a head stop plate 20*a* and a side stop plate 20*b* for cooperating with the restraining tabs 17 to maintain the bed springs (not shown) in desired use position on the bed frame 10.

More particularly, each cross rail 14, 15 of the bed frame 10 is comprised of a first or left hand cross rail section 14*a* and 15*a*, and a second or right hand cross rail section 14*b* and 15*b*. The left hand cross rail section 14*a* and 15*a* of each cross rail section pair 14 and 15 is pivotally connected to its left hand side rail 12 on vertical pivot axes 22, and the right hand cross rail section 14*b* and 15*b* of each cross rail section pair 14 and 15 is pivotally connected to its right hand side rail 13 on vertical pivot axes 22. These pivot interconnections 22 are established by suitable pins 23, not shown in detail. The pivot connections permit each cross rail section 14*a*, 14*b*, 15*a*, 15*b*, to swing between a storage position (shown in FIGS. 2B and 3B) in which the cross rail section is oriented parallel to and juxtaposed to its related side rail, and a bed support or use position (shown in FIGS. 1, 2A and 3A) oriented normal to its related side rail.

Figure 6:
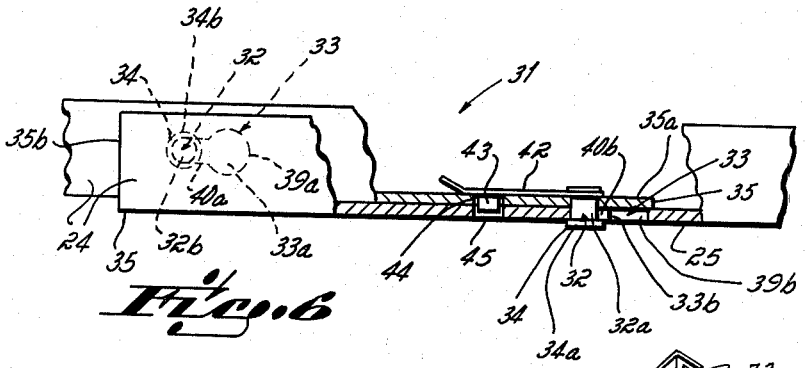
FIG. 6 is a cross-sectional view taken along line 6—6 of FIG. 1.

The cross rail sections 14*a*, 14*b* and 15*a*, 15*b* are connected in fixed relation one with the other adjacent the longitudinal center line 30 of the bed frame 10, thereby fixing the bed frame in the erected or use attitude as illustrated in FIG. 1. The interconnect structure 31 for each pair 14*a*, 14*b* and 15*a*, 15*b* of cross rail sections, as illustrated in FIGS. 1 and 6, is comprised of a pin 32 and keyhole slot 33 arrangement, a pin 32 and slot 33 being provided on each web 24 and 25 of each cross rail section. As shown in detail in FIG. 6 for cross rail 15, a first 32*a* pin with enlarged head 34*a* is connected to and extends outwardly from the outer end 35*a* of cross rail section 15a on vertical web 25. A second pin 32*b* with enlarged head 34*b* is connected to and extends downwardly from the outer end 35*b* of cross rail section 15*b* on horizontal web 24. Pin 32*a* on cross rail section 15*a* is adapted to be received in a keyhole slot 33*b* having an enlarged opening 39*b* at one end (that opening 39*b* being sized to receive the pin's head 34*a* therethrough), and a narrowed throat 40*b* at the other end (that throat 40*b* being sized to lock the pin 32*a* within the slot 33*b*), the slot 33*b* being in cross rail section 15*b*, and being located between side rail 13 and end 35*b* on the cross rail section 15*b*. Similarly, pin 32*b* on cross rail section 15*b* is adapted to be received in keyhole slot 33*a* having an enlarged opening 39*a* at one end (that opening being sized to receive the pin's head 34*b* therethrough), and a narrowed throat portion 40*a* at the other end (that throat 40*a* being sized to lock pin 32*b* within the slot 33*a*), the slot 33*a* being in cross rail section 15*a*, and being located between side rail 12 and end 35*a* on that cross rail section 15*a*. Note both slots 33*a* and 33*b* are oriented on cross rail sections 15*a*, 15*b* so that throats 40*a*, 40*b* face the same side rail, which is side rail 12 as shown.

In use, the cross rail ections 14*a*, 14*b* and 15*a*, 15*b* of each pair are simply swung outwardly from side rails 12, 13 and then aligned in nested fashion with one another. The pins 32*a*, 32*b* are then aligned with and pass through the enlarged openings or holes 39*b*, 39*a*, respectively, of the respective keyhole slot structure 33*b*, 33*a* in the juxtaposed cross rail sections. Those juxtaposed cross rails 14*a*, 14*b* and 15*a*, 15*b* are then telescoped or drawn away from one another until the pins 32*a*, 32*b* are seated in the narrowed slot throats 40*a*, 40*b* as shown in FIG. 6. Each cross rail pair 14*a*, 14*b* and 15*a*, 15*b* is maintained in this erected or use attitude shown in FIGS. 1 and 6 by a spring 42 loaded stud 43, thereby maintaining the side 12, 13 and cross 14, 15 rails in the erected or use bed frame 10 attitude shown in FIG. 1. The spring 42 is a leaf type spring and is fixed on side rail section 15*a* by pin 32*a* as shown in FIG. 6. The stud 43 is spring 42 loaded through hole 44 in the cross rail section 15*a* to which it is connected, and into hole 45 in the adjacent cross rail section 15*b*, when those cross rail sections are connected together as illustrated in FIG. 6. To collapse the bed frame 10 from the FIG. 1 to a storage attitude, the spring 42 loaded studs 43 are withdrawn from holes 45 and the respective pairs 14*a*, 14*b* and 15*a*, 15*b* of cross rail sections disconnected. Those cross rail sections 14*a*, 14*b*, 15*a*, 15*b* are thereafter swung or pivoted inwardly on pivot axes 22, as shown by arrows 47, into a storage attitude (partially shown in FIGS. 2B and 3B) in which those cross rail sections are oriented parallel to their respective side rails 12, 13, and juxtaposed or nested thereagainst.

As mentioned heretofore, each of the four corners of the bed frame 10 is provided with a leg structure 11, which leg structure carries a caster or roller 16 at the bottom end thereof, see FIG. 1. Each leg structure 11 is permanently mounted to a cross rail section 14 or 15 adjacent the pivotal interconnection, i.e., adjacent pivot axis 22, of that cross rail section with its respective side rail 12 or 13, see FIGS. 2 and 3. Importantly, note that each leg structure 11 is the same as all others whether it is mounted to cooperate with the left hand side rail 12 or the right hand side rail 13, the leg structure 11 being fixed to each cross rail 14, 15 on the same side (the peripherally exterior side as shown) of that cross rail at each end thereof, thereby permitting a single leg structure 11 to be fabricated for all of the four corners of the bed frame 10. In other words, and as to each cross rail 14 and 15, a leg of the same leg structure 11 is mounted at both of the bed frame's two corners as defined by that cross rail.

The leg structure 11 is particularly illustrated in FIGS. 2–5. Each leg structure 11 includes a leg member 50 of a generally channel shape, i.e., U-shaped, at the upper end of that leg member when viewed in a cross-sectional plane taken parallel to the support plate 27 of the bed frame 10. An outwardly extending wing 51 and 52 is fixed to each side wall 53 of the U-shaped leg 50 at the edge 54 thereof. The wings 51, 52 are disposed in a common plane that is parallel to the leg's center web 55, that center web connecting side walls 53. The wings 51, 52 and, hence, the leg 50, are permanently fixed to downwardly depending web or side rail 25 of a cross rail setion by rivets 56 or the like in a manner that orients the leg member's longitudinal center plane 57 normal to the longitudinal axis of that cross rail section. When so mounted, and as illustrated in FIGS. 2 and 3, the top end edge 58 of the leg member 50 is disposed in the plane of the top face of the cross rail's horizontal web 24. Note also that the U-shaped leg member 50 is mounted to the cross rail section in a manner that defines a space or gap G between the center web 55 of the leg 50 and the depending side wall 25 of the cross rail section.

A latch tab 60 is connected to the leg member's center web 55 at the top edge 58 of the leg, see FIGS. 2–5. The latch tab 60 is disposed parallel to the support plane 27 of the bed frame 10, and is spaced above the top edge 58 of the leg, i.e. above the top face of the cross rail's horizontal web 24, a distance D slightly greater than the thickness T of the adjacent side rail's horizontal wall 61. Thus, the latch tab 60 extends normal to the leg member's longitudinal center plane 57, and is elevated above the top edge 58 of that leg member, see FIG. 5. The latch tab 60 is connected to the leg member 50 at the top edge 58 thereof by a neck section 62, the neck section being centrally located of the leg's center web 55 and having a width W substantially less than the width W′ of the latch tab, and having a width W less than the width W″ of the leg member's center web, see FIG. 4. Since the width W′ of the latch tab 60 is no greater than the width W″ of the leg member's center web 55, the latch tab and neck section 62 can be struck and formed from the center web of an oversized length of channel or U-shaped stock.

Figure 5:
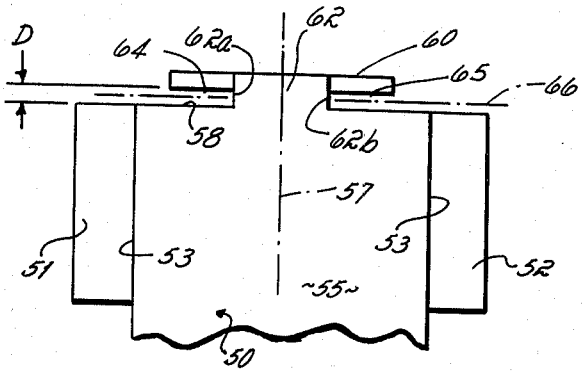
FIG. 5 is a side view of the novel leg structure.

The latch tab 60, edges **62*a*, 62*b* of the neck section 62, and the leg member's top edge 58, all cooperate to define two slots 64, 65, one on each side of the leg member's longitudinal center plane 57. The two slots 64, 65 lie in a slot plane 66 normal to the leg member's longitudinal center plane 57, and those slots open away from one another in mirror relation one to the other on opposite sides of that center plane 57 to establish left hand slot 64 and right hand slot 65, all as shown in FIG. 5. The mirror relation of the two slots 64, 65, i.e., the left hand slot 64 and right hand slot 65 arrangement, is important in that only a single leg structure 11 need be fabricated for each of the bed frame's four corners. In other words, the leg structure illustrated in FIGS. 2 and 3 may be used on any of the four corners of the bed frame, i.e., in combination with either left hand 12 or right hand 13 side rails, as those side rails 12, 13 are shown oriented in the Figures. This is important from a manufacturing economy standpoint for the reason that only one leg structure 11**, and not two different leg structures, is required for fabrication of the bed frame.

Figure 2A:
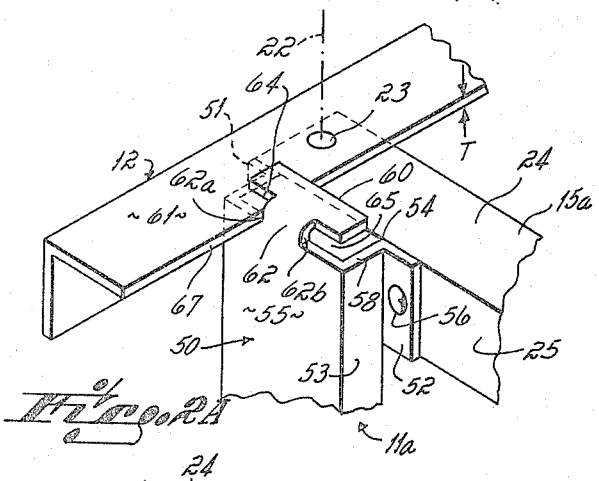
FIG. 2A is an enlarged perspective view of that area 2A of the bed frame encircled in FIG. 1, the novel leg structure and the left hand foot rail section being shown in bed support or use position relative to the left hand side rail.
Figure 2B:
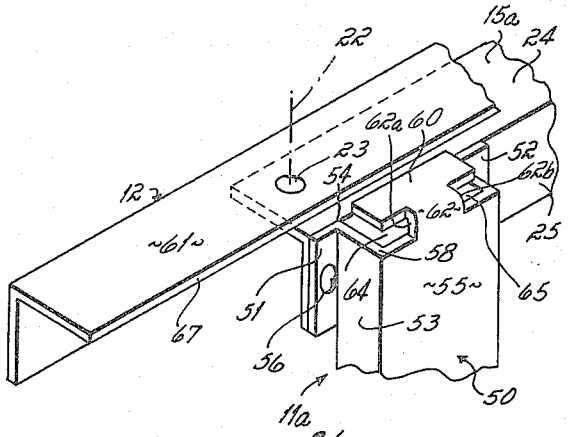
FIG. 2B is similar to FIG. 2A but showing the novel leg structure and left hand foot rail section in a storage position relative to the left hand side rail.
Figure 3A:
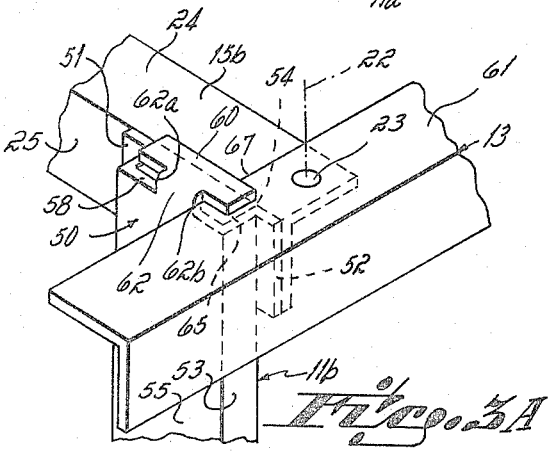
FIG. 3A is a view of that area 3A of the bed frame encircled in FIG. 1, the novel leg structure and the right hand foot rail section being shown in bed support or use position relative to the right hand side rail.
Figure 3B:
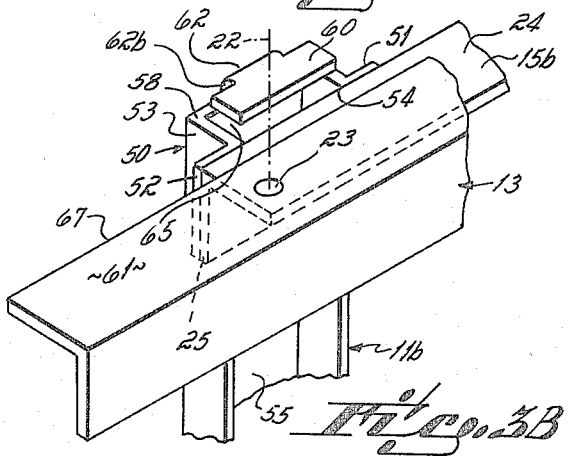
FIG. 3B is similar to FIG. 2B but showing the novel leg structure and right hand foot rail section in a storage position relative to the right hand side rail.
Figure 4:
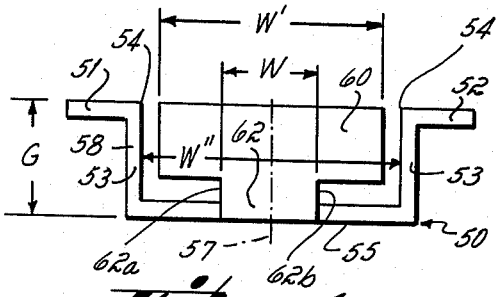
FIG. 4 is a top view of the novel leg structure.

In use, and relative to the foot rail 15, as left hand cross rail section **15*a* is swung from the storage attitude adjacent the left hand side rail 12 shown in FIG. 2B into the use position shown in FIG. 2A, the side rail's horizontal web or top wall 61 is received in left hand slot 64, i.e., is located in slot 64 between latch tab 60 and the leg member's top edge 58, of the leg structure 11*a*, to support the cross rail section 15*a* in position during use of the erected bed frame. Since the leg member's top edge 58 is coplanar with the cross rail section's top face 24, the side rail's top wall 61 is also received between the latch tab 60 and top face 24 of that cross rail section 15*a* to restrain or support the cross rail section 15*a* in position during use of the erected bed frame. The location of edge 62*a* of the neck section 62 is fabricated, relative to the leg's center longitudinal plane 57, in a manner that locates the cross rail section 15*a* in the normal attitude relative to the side rail 12. In other words, the cross rail section 15*a* is swung out until edge 67 of the side rail's horizontal wall 61 abuts edge 62*a* of the neck 62, thereby permitting the leg structure 11*a* to locate and partially support the cross rail section 15*a* in a substantially perpendicular use attitude relative to the side rail 12. Of course, in this attitude the tab 60 overlies that side rail 12**.

In like manner, right hand cross section **15*b* is swung into use position with its right hand side rail 13 and leg structure 11*b*. Leg structure 11*b* is of identical structure to leg structure 11*a*, and is mounted on same side of cross rail section 15*b* as is leg structure 11*a* mounted on cross rail section 15*a*, i.e., the outside peripheral edge as shown. But the right hand side rail's horizontal web 61 is received in right hand slot 65 of leg structure 11*b*, i.e., is located in slot 65 beneath latch tab 60. The structural and functional relationship of right hand side rail 13 and right hand leg structure 11*b* is, therefore, identical with that of left hand side rail 12 and left hand leg structure 11*a*, except that left hand slot 64 is used on the left hand side of the bed frame 10 and right hand slot 65** is used on the right hand side of the bed frame.

The structure and function of the leg structures 11 on head rail sections **14*a*, 14*b* is not shown in detail, but is the same as the previously explained for the foot rail sections 15*a*, 15*b*, relative to the side rails 12, 13**.

Figure 7:
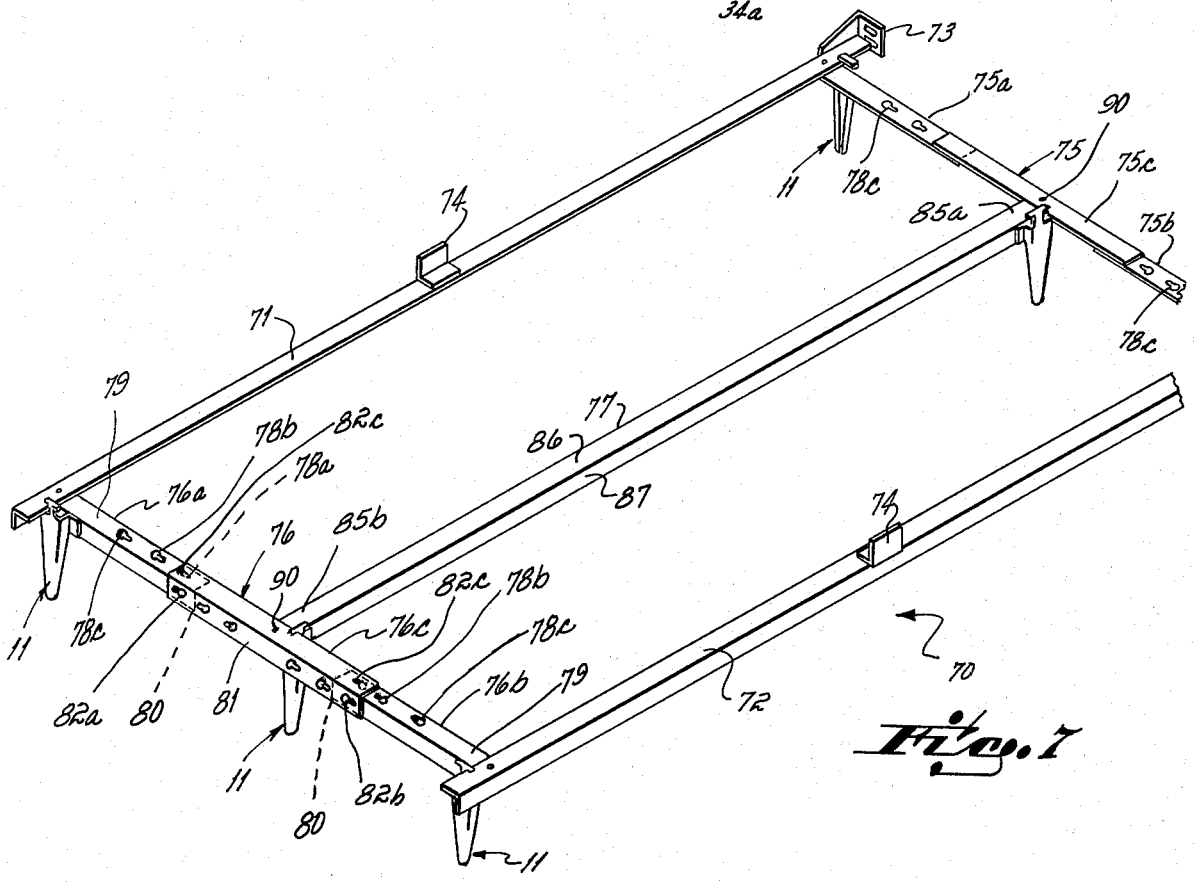
FIG. 7 is a perspective view of a second bed frame embodiment incorporating a novel leg structure, all in accord with the principles of this invention.

The second bed frame embodiment 70 and leg structure 11 of this invention is illustrated in FIGS. 7–10. The second bed frame embodiment 70 is adjustable widthwise to provide a bed width size known as 'king size,' 'california king size,' or 'queen size,' as desired by the bed user and as is explained in further detail below. The bed frame 70 includes opposed side rails, i.e., left hand 71 and right hand 72 side rails, which are disposed in parallel relation one to the other when the bed frame is erected in the use position as shown in FIG. 7. A headboard mounting plate 73 is connected to each side rail 71, 72 at the head end thereof, as is well known to the prior art. The headboard mounting plates 73 illustrated in this second bed frame embodiment are the same as the headboard mounting plates 20 described in the first bed frame 10 embodiment. The side rails 71, 72 also are provided with restraining tabs 74 which are identical to those tabs 17 earlier described in connection with the first bed frame 10 embodiment.

The bed frame 70 includes a head rail 75 and a foot rail 76, i.e., cross rails, which are disposed parallel one to the other, and which are disposed normal to the side rails, when the bed frame is erected in the use position illustrated in FIG. 7. The bed frame 70 also includes a center rail 77 which interconnects the cross rails 75, 76 substantially midway therebetween, and which is disposed parallel to the side rails 71, 72 when the bed frame is in the use position, see FIG. 7. The novel leg structure 11 is provided at each outer corner of the bed frame 70, that novel leg structure having the same structural characteristics and function as earlier described above in connection with the first bed frame 10 embodiment (hereinafter the reference numbers of the leg structure 11 on bed frame 70 will be the same as used in describing that same leg structure on bed frame 10). Further, the same novel leg structure 11 is provided at each inner corner of the bed frame 70 defined by the intersections of the center rail 77 with the head cross rail 75 and foot cross rail 76, respectively.

Figure 10:
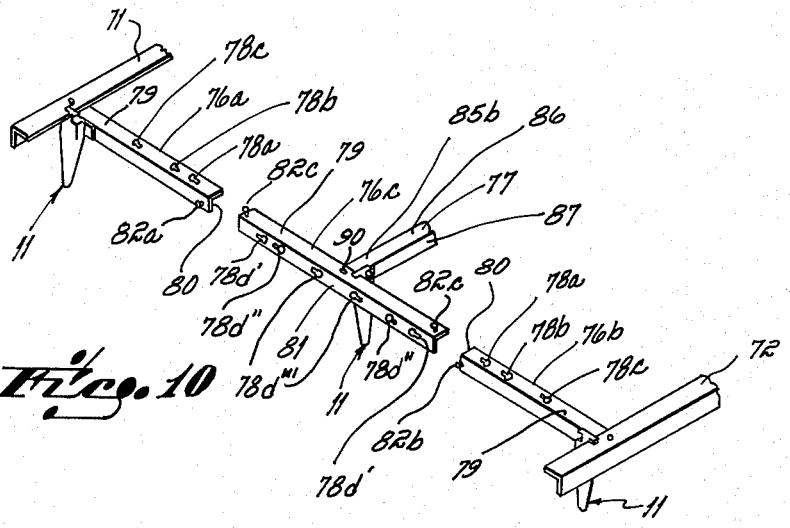
FIG. 10 is a partial perspective view of the bed frame shown in FIG. 7, the attitude of the major component parts being illustrated prior to assembly into the bed frame configuration.

Each of the head 75 and foot 76 cross rails is of the same three-part or three-rail structure. In connection with the foot rail 76, and as is shown in FIG. 10, that rails includes a left hand rail section **76*a* pivotally mounted to the left hand side rail 71 in the same manner as described above in connection with the first bed frame 10 embodiment. Further, the foot rail 76 includes a right foot rail section 76*b* pivotally mounted to the right hand side rail 72 in the same manner as described above in connection with the first bed frame 10 embodiment. Both these foot rail sections 76*a*, 76*c* include a novel leg structure 11*a*, 11*b* fixed thereto in the same manner as described above for the first bed frame 10 embodiment. However, the foot cross rail 76 includes a linking foot rail section 76*c* adapted to interconnect the left hand 76*a* and the right 76*b*** hand cross rail sections.

Each of the pivotally connected foot rail sections **76*a*, 76*b* includes three spaced apart keyhole slots 78*a*, 78*b*, 78*c* on the horizontal web 79 thereof and adjacent the free end 70 thereof, see FIG. 10. The three keyhole slots 78*a*, 78*b*, 78*c* on each foot rail section 76*a*, 76*b* are symmetrically positioned relative to the free ends 80 of those sections. In each set of three keyhole slots 78*a*, 78*b*, 78*c*, the inner slots 78*a*, 78*a*' are to be used if the bed frame is to be erected in the 'king size,' the middle slots 78*b*, 78*b*' are to be used if the bed frame is to be erected in the 'california king size,' and the outer slots 78*c*, 78*c*' are to be used if the bed frame is to be erected in the 'queen size.' The vertical web 81 of each foot cross rail section 76*a*, 76*b* has a headed pin 82*a*, 82*b* fixed thereto, and extending outwardly therefrom, at the free end 80 of that section. The pin 82 and slot 78 structure has the same structural characteristics as the pin 32 and slot 33 structure described in connection with the first bed frame 10** embodiment.

As previously mentioned, the left **76*a* and right 76*b* hand foot rail sections are adapted to be interconnected together by a linking foot rail section 76*c* also of right angular configuration and also oriented, in the interconnect attitude, with the vertical web 81 extending downwardly from the horizontal web 79 as illustrated in FIGS. 7 and 10. The linking foot rail section 76*c*, on the horizontal web 79 thereof, includes a headed pin 82*c* fixed at each end thereof, those pins depending from the underside of web 79. The linking foot rail section's vertical web 81 is also provided with a series of three keyhole slots 78*d* at each end thereof, namely, a 'king size' slot 78*d*', a 'california king size' slot 78*d*'' and a 'queen size' slot 78*d*'''. Note that the keyhole slots 78*d* on that end of the linking foot rail section 76*c* which are adapted to cooperate with the keyhole slots 78*a*, 78*b* or 78*c* on the free end of the adjacent pivotally mounted foot rail section 76*a* face toward one another, and those corresponding slots on the right section 76*b* are faced by the mating slots in the other free end of 76*c*, i.e., the slots in series 78*a*–78*d***, face in opposite directions according to the left and right hand sides.

In assembly, and once it has been determined whether the bed frame 70 is to be set up as a 'king size' bed, a 'california king size' bed, or a 'queen size' bed, the pins **82*a*, 82*b* on the free ends of the left 76*a* and right 76*b* hand foot rail sections are aligned with the desired keyhole slots 78*d* in the respective adjacent ends of the linking foot rail section 76*c*, and the pins 82*c* on the ends of the linking foot rail section 76*c* are aligned with the desired keyhole slots 78*a*, 78*b*, 78*c* in the respective adjacent ends of the left 76*a* and right 76*b* hand foot rail sections. Thereafter, the pins 82*a*, 82*b* and 82*c* are passed through the enlarged openings or holes of the respective keyhole slots in the juxtaposed foot rail sections 76*a*, 76*b*, 76*c*. The left 76*a* and right 76*b* hand foot rail sections are then drawn away from one another until the pins 82*a*, 82*b*, 82*c* are seated in the narrow slot throats of the keyhole slots 78*a*, 78*b*, 78*c*, 78*d* in the cross rail 76. This interconnect structure thereby serves to interconnect the three-part foot rail 76*a*, 76*b*, 76*c* at the foot of the bed frame 70. In a like manner, and by like structure the left 75*a* and right 75*b* hand head rail sections, and the linking head rail section 75*c*, are connected into head rail 75 at the head of the bed frame 70**.

The center rail 77 includes a leg structure 11 mounted at each end 85 thereof, i.e., at head end **85*a* and at foot end 85*b*. The center rail 77 is also of the right angle rail configuration, and includes a top horizontal web 86 and a vertical web 87 downwardly depending therefrom. Each leg structure 11 is connected to the center rail 77 on the vertical web 87 by rivets 88 in the same manner previously described in connection with the first bed frame 10 embodiment. Further, and importantly, the leg structure 11 mounted to each end 85*a*, 85*b* of the center rail 77 is the very same as leg structure 11 mounted at the four outer corners of the bed frame 70. This leg structure 11 was described above in detail in connection with the first bed frame 10** embodiment.

As previously noted, the center rail 77 is interconnected with the bed frame 70 by direct connection to the linking cross rail sections **75*c*, 76*c* of the head 75 and foot 76 cross rails, respectively, at each end of that center rail. These connections define the inner corners of the bed frame 70. The center rail 77 is connected at each end to a linking cross rail by the same pin 82 and keyhole slot 78 structure earlier described. As illustrated particularly in FIGS. 8 and 9, each end 85*a*, 85*b* of the center rail 77 is provided with a keyhole slot 89 with the keyhole slot being oriented so that the narrowed throat is directed toward the end edge 87 of the center rail. The keyhole slots 89 in the center rail 77 are in the horizontal web 86 of that center rail. A pin 90 is mounted on each linking cross rail 75*c*, 76*c* approximately midway between the ends of that cross rail. These centrally positioned linking cross rail pins 90 are mounted to depend from the underside or bottom face of the linking cross rails' horizontal webs 86**.

Figure 8:
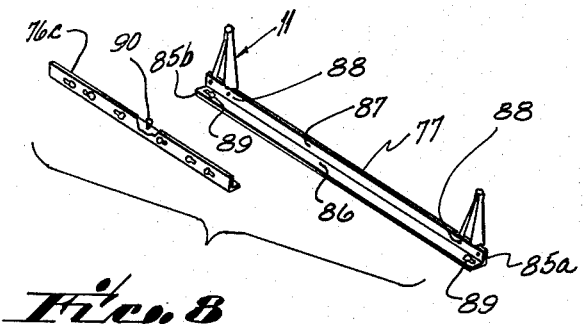
FIG. 8 is a perspective view of the center rail, and of one linking cross rail section, which comprise a portion of the bed frame illustrated in FIG. 7.

Assembly of the center rail 77 with the linking cross rails 75*c*, 76*c* is the same for both linking cross rails. As illustrated in FIG. 8, the center rail 77 is first oriented substantially parallel to a linking cross rail 75*c* or 76*c*, and the center pin 90 then being aligned with and passed through the enlarged opening or hole of the keyhole slot 89 at the adjacent end of the center rail. The center rail 77 is then moved parallel to the linking cross rail 75*c* until the pin 90 is seated in the narrowed slot throat of the keyhole slot 89 in that center rail, all as illustrated in solid lines in FIGS. 8 and 9. Thereafter, the linking cross rail 75*c* is pivoted or swung relative to a phantom axis 91 defined by the pin 90 connection in that rotational direction 92 which permits the linking cross rail 75*c* to be positioned perpendicular or normal to the center rail 77, note the phantom line attitude of the linking cross rail in FIG. 9.

Figure 9:
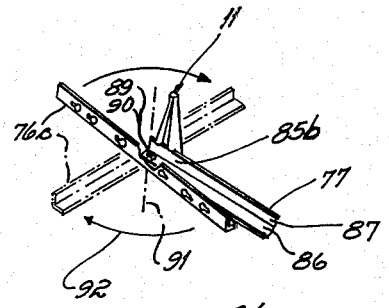
FIG. 9 is an enlarged perspective view illustrating assembly of the bed frame components shown in FIG. 8.

Importantly, and as the linking foot rail section 76*c* is being swung in the direction of arrows 92 between the initial assembly attitude shown in solid lines in FIG. 9 and the final assembly attitude shown in phantom lines in FIG. 9, the horizontal web 79 of the linking cross rail is received in left hand slot 64 of the leg structure 11, i.e., it is located in the left hand slot between the latch tab 60 and the leg member's top edge 58 of the leg structure 11*a* to support the linking foot rail 77 in position during use of the erected bed frame. In a like manner, the linking head rail section 75*c* is connected with the head end of the center rail 77. But, the linking head rail section's horizontal web 79 is received in the right hand slot 65, i.e., is located in slot 65 between latch tab 60 and the leg member's top edge 58, of the leg structure 11*a*, to support the linking cross rail section 75*c* in position during use of the erected bed frame 70, all as illustrated in FIG. 7. Thus, and in use of the second bed frame 70 embodiment, the same leg structure 11 is used at both ends of the center rail 77, linking foot rail section's horizontal web 79 being received in left hand slot 64 beneath latch tab 60, and the linking head rail section's horizontal web 79 being received in right hand slot 65 between latch tab 60 and the leg member's top edge 58, all for the purpose of supporting the linking cross rail sections 75*c*, 76*c* during use of the erected bed frame 70 in light of the greater width of the second bed frame 70 embodiment vis-a-vis the width of the first bed frame 10 embodiment.

Having described in detail the preferred embodiment of my invention, what I desire to claim and protect by Letters Patent is:

1. A novel leg structure for a bed frame, said bed frame being of the type that includes a right angle rail and a leg rail pivotally connected to that right angle rail for swinging movement between a storage position in which the leg rail is oriented parallel to the right angle rail, and a use position where the leg rail is oriented normal to the right angle rail, said leg structure comprising a leg member mountable to said leg rail at a location adjacent the pivotal connection of said leg rail with said right angle rail, a latch tab connected with said leg member by a neck having a width less than the width of said latch tab, said latch tab extending normal to said leg member's longitudinal center plane, and said latch tab being spaced above said leg member's top edge, and said latch tab and neck cooperating to define two slots, said two slots being in a slot plane normal to said leg member's longitudinal center plane, said two slots being disposed in generally mirror relation one to the other on opposite sides of said leg member's longitudinal plane, said two slots being oriented to open away from one another in that mirror relation, said right angle rail's horizontal web being receivable in one of said slots as said leg rail is pivoted from the storage attitude to the use attitude for locating said right angle rail's horizontal web beneath said latch tab to support said leg rail relative to said right angle rail when the bed frame is erected, and said latch tab and neck structure permitting said leg member to be mounted to said leg rail at any bed frame corner defined by said leg rail and said right angle rail without regard to left hand side or right hand side of said leg rail.

2. A novel leg structure as set forth in claim 1, the top edge of said leg member being disposed in the plane of the top face of said leg rail when connected thereto.

3. A novel leg structure as set forth in claim 1, the edges of the said neck being positioned to contact the edge of said right angle rail's horizontal web when said right angle rail is pivoted into the use attitude from the storage attitude, that contact serving to locate said right angle rail substantially perpendicular to said leg rail.

4. A novel leg structure as set forth in claim 1 wherein said right angle rail is a side rail and wherein said leg rail is a cross rail.

5. A novel leg structure as set forth in claim 1 wherein said right angle rail is a cross rail and wherein said leg rail is a center rail.

6. A novel leg structure as set forth in claim 1 including a wing extending outwardly from and mounted to the edge of each side of said U-shaped leg member, said wing being oriented normal to said leg member's longitudinal plane, and said leg member being mountable to said leg rail by use of said wings.

7. A bed frame comprising a left hand side rail and a right hand side rail, said side rails being of a right angle cross section, and said side rails being disposed in parallel relation one to the other, a cross rail comprised of a pair of sections, a left hand section of said cross rail being pivotally connected to said left hand side rail, and a right hand section of said cross rail being pivotally connected to said right hand side rail, each of said cross rail sections being swingable between a storage position in which that section is oriented parallel to its respective side rail and a use position in which that section is oriented normal to its respective side rail, a leg structure mounted to each section of said cross rail adjacent the pivotal connection of that section with its respective side rail, each leg structure being identical to the other relative to those structural elements which include a leg member having a latch tab connected thereto by a neck, said neck having a width less than the width of the latch tab, said latch tab extending normal to a longitudinal plane of said leg member, and said latch tab being spaced above said leg member's top edge, said latch tab, neck and leg member's top edge cooperating to define two slots in generally mirror relation one to the other on opposite sides of said leg member's longitudinal plane, said two slots opening away from one another in that mirror relation, thereby defining a left hand slot and a right hand slot, said left hand side rail's horizontal web being received in one of said slots as to that leg structure mounted on said left hand cross rail section, and said right hand side rail's horizontal web being received in the other of said slots as to that leg structure mounted on said right hand cross rail sections, as said cross rail sections are swung from the storage attitude to the use attitude, thereby permitting the same leg structure to be mounted to both of the cross rail sections at those two of the bed frame's corners served by those cross rail sections without regard to left hand side or right hand side of the bed frame.

8. A bed frame as set forth in claim 7 in which said leg member is of a generally U-shaped cross section at the top end thereof, said leg member being mounted to the cross rail so that said leg member's longitudinal plane is normal to said cross rail, and said latch tab being connected by said neck with said leg member's center web.

9. A bed frame as set forth in claim 8 including a wing extending outwardly from and mounted to the edge of each side of said U-shaped leg member, said wing being oriented perpendicular to said leg member's longitudinal plane, and said leg member being mountable to said cross rail by use of said wing.

10. A bed frame as set forth in claim 7, the top edge of said leg member being disposed in the plane of the top face of said cross rail section.

11. A bed frame as set forth in claim 7, the edges of said neck being positioned to contact the edge of said side rail's horizontal web when said side rail is pivoted into the use attitude from the storage attitude, that contact serving to locate said side rail substantially perpendicular to said cross rail section.

12. A bed frame as set forth in claim 7 including a center rail disposed parallel to said side rails, and a linking cross rail section of a right angle cross section, and said linking cross rail section being pivotally mounted to said center rail at one end thereof, and a leg structure mounted to said center rail adjacent the pivotal connection of that center rail with said linking cross rail section, said leg structure being identical to those leg structures mounted to said left hand and right hand cross rail sections.

13. A bed frame as set forth in claim 12 including connector structure partially carried on said linking cross rail section and partially carried on said left and right hand cross rail sections, and said connector structure being adjustable to permit erecting said bed frame in at least two different widths.

* * * * *